US008335450B1

(12) United States Patent
Daloia et al.

(10) Patent No.: US 8,335,450 B1
(45) Date of Patent: Dec. 18, 2012

(54) METHOD FOR EXTERNALLY HEATING A PHOTORECEPTOR

(75) Inventors: Gerald F Daloia, Webster, NY (US); Michael A Doody, Manchester, NY (US); Edward C Savage, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/160,845

(22) Filed: Jun. 15, 2011

(51) Int. Cl.
*G03G 15/00* (2006.01)
*G03G 21/20* (2006.01)

(52) U.S. Cl. ..... 399/96; 399/97

(58) Field of Classification Search ..... 399/96, 399/44, 94, 97, 100, 115, 168, 170, 173, 399/311
See application file for complete search history.

(56) References Cited

U.S. PATENT DOCUMENTS

| | | | | |
|---|---|---|---|---|
| 3,847,478 | A | 11/1974 | Young | |
| 4,161,357 | A | 7/1979 | Herman et al. | |
| 5,019,682 | A | 5/1991 | Lee | |
| 7,599,642 | B2 | 10/2009 | Nakajima et al. | |
| 2002/0131785 | A1 * | 9/2002 | Ito | 399/44 |
| 2005/0265750 | A1 * | 12/2005 | Blair et al. | 399/170 |
| 2007/0237547 | A1 * | 10/2007 | Zona et al. | 399/168 |

FOREIGN PATENT DOCUMENTS

JP 63159883 A * 7/1988

OTHER PUBLICATIONS

Machine translation of reference Horiuchi et al. (JP 2008-298,837 A), Pub date Dec. 11, 2008.*

* cited by examiner

*Primary Examiner* — Walter L Lindsay, Jr.
*Assistant Examiner* — Rodney Bonnette

(57) ABSTRACT

A thick film charging device is used to simultaneously heat a photoreceptor as it is being charged in order to mitigate image quality defects associated with the photoreceptor in high humidity conditions.

20 Claims, 3 Drawing Sheets

METHOD FOR EXTERNALLY HEATING A PHOTORECEPTOR

CROSS-REFERENCE TO RELATED APPLICATIONS

Cross-reference is hereby made to commonly assigned and co-pending U.S. application Ser. No. 13/030,220, filed Feb. 18, 2011, and entitled "Limited Ozone Generator Transfer Device" by Gerald F. Daloia, et al., and co-pending U.S. application Ser. No. 13/160,836, filed Jun. 15, 2011, and entitled "Photoreceptor Charging and Erasing System" by Gerald F. Daloia, et al. The disclosures of the heretofore-mentioned applications are incorporated herein by reference in their entirety.

BACKGROUND

1. Field of the Disclosure

The present disclosure relates generally to an electrostatographic printing apparatus, and more particularly, concerns externally heating a photoreceptor used in such a machine.

2. Description of Related Art

Typically, in an electrostatographic printing process of printers, a photoconductive or photoreceptor member is charged by a charging device to a substantially uniform potential so as to sensitize the surface thereof. The charged portion of the photoreceptor member is exposed to selectively dissipate the charges thereon in the irradiated areas. This records an electrostatic latent image on the photoreceptor member. After the electrostatic latent image is recorded on the photoreceptor member, the latent image is developed by bringing a developer material into contact therewith. Generally, the developer material comprises toner particles adhering triboelectrically to carrier granules. The toner particles are attracted from the carrier granules either to a donor roll or to a latent image on the photoreceptor member. The toner attracted to the donor roll is then deposited on latent electrostatic images on a charge retentive surface, which is usually a photoreceptor. The toner powder image is then transferred from the photoreceptor member to a copy substrate.

In order to fix or fuse the toner material onto a support member permanently by heat, it is necessary to elevate the temperature of the toner material to a point at which constituents of the toner material coalesce and become tacky. This action causes the toner to flow, to some extent, onto fibers or pores of the support members or otherwise upon surfaces thereof. Thereafter, as the toner materials cool, solidification of the toner materials occurs causing the toner material to be bonded firmly to the support member.

Transfer is typically carried out by the creation of a "transfer-detack zone" (often abbreviated to just "transfer zone") of AC and DC biases where the print sheet is in contact with, or otherwise proximate to, the photoreceptor member. A DC bias applied to the back (i.e., on the face away from the photoreceptor member) of the paper or other substrate in the transfer zone electrostatically transfers the toner from the photoreceptor member to the paper or other substrate presented to the transfer zone. The toner particles are heated to permanently affix the powder image to the copy substrate. Biased transfer rolls are also used to transfer an image from a photoreceptor member to media, for example, the segmented bias roll disclosed in U.S. Pat. No. 3,847,478.

In high humidity environments, such as, greater than 70% relative humidity, a problem is sometimes encountered in some machines when certain ionic species generated by corona combine with moisture on the photoreceptor surface to form conductive paths. The surface charge corresponding to the electrostatic latent image moves. This distorts the integrity of the latent image. The result is observed as image blur. Aggressively refreshing the photoreceptor surface (high wear rates typically in the range of 20 to 100 nm/k cycle) is the usual method used to avoid this problem. Well known in the art is the use of drum heaters that usually reside inside the photoreceptor drum to reduce surface moisture as shown, for example, in U.S. Pat. Nos. 4,161,357; 5,019,682; and 7,599,642 B2. Other techniques for controlling moisture on a photoreceptor are related to the addition of material additives in the photoreceptor composition to reduce this effect. Additionally, air circulation around the charging devices or the use of expensive coatings on charge devices has been tried. These traditional fixes have related drawbacks of added expense, additional power consumption, low photoreceptor life, or limitations on operating environment.

Thus, there is still a need for a method for controlling moisture on the surface of a photoreceptor that is inexpensive, low in power consumption and is not detrimental to the life of the photoreceptor.

BRIEF SUMMARY

In answer to this need, provided hereinafter is a method of externally heating a xerographic photoconductor without added power consumption or additional space/hardware requirements that includes providing a thick film charging device to simultaneously charge and heat a photoreceptor in order to mitigate image quality defects associated with the photoreceptor in high humidity conditions.

The disclosed system may be operated by and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as, those provided herein, and/or prior knowledge of functions which are conventional, together with general knowledge in the software of computer arts. Alternatively, any disclosed control system or method may be implemented partially or fully in hardware, using standard logic circuits or single chip VLSI designs.

The term 'printer' or 'reproduction apparatus' as used herein broadly encompasses various printers, copiers or multifunction machines or systems, xerographic or otherwise, unless otherwise defined in a claim. The term 'sheet' herein refers to any flimsy physical sheet or paper, plastic, media, or other useable physical substrate for printing images thereon, whether precut or initially web fed. A compiled collated set of printed output sheets may be alternatively referred to as a document, booklet, or the like. It is also known to use interposes or inserters to add covers or other inserts to the compiled sets.

As to specific components of the subject apparatus or methods, it will be appreciated that, as normally the case, some such components are known per se' in other apparatus or applications, which may be additionally or alternatively used herein, including those from art cited herein. For example, it will be appreciated by respective engineers and others that many of the particular components mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

BRIEF DESCRIPTION OF THE DRAWINGS

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

DETAILED DESCRIPTION OF THE PREFERRED EMBODIMENT

Figure 1:
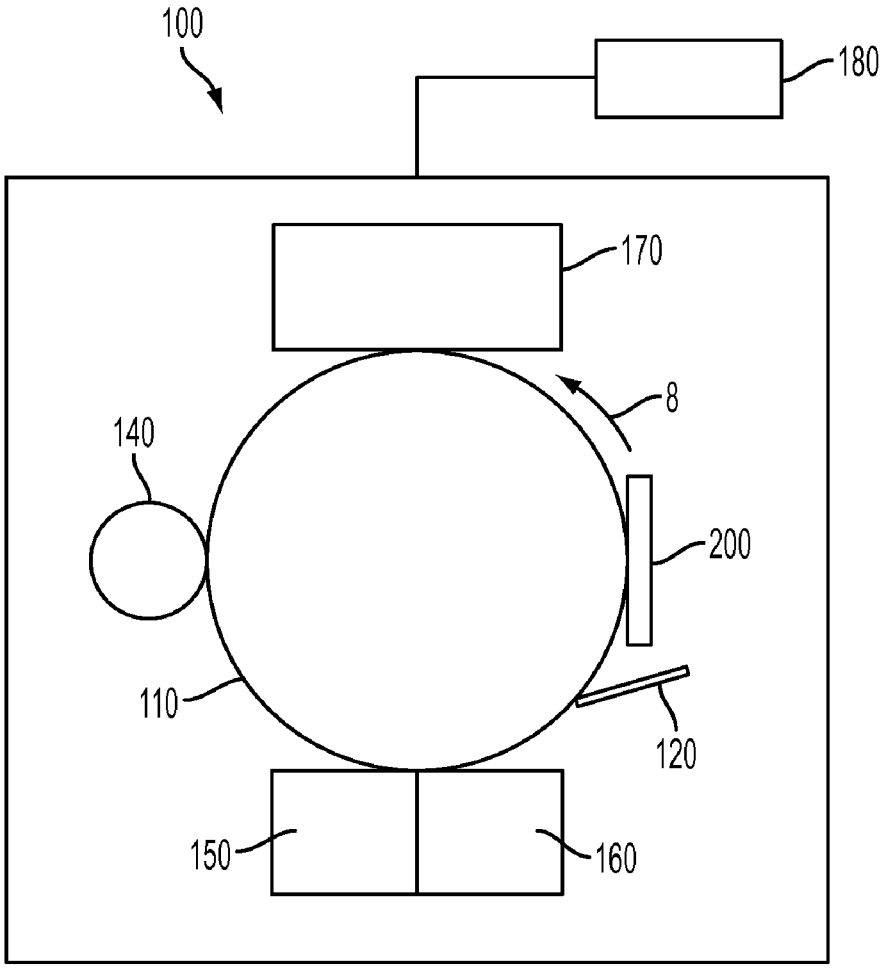
FIG. 1 is a partial, frontal view of an exemplary modular xerographic printer that includes the dual purpose thick film charging device of the present disclosure.

While the disclosure will be described hereinafter in connection with a preferred embodiment thereof, it will be understood that limiting the disclosure to that embodiment is not intended. On the contrary, it is intended to cover all alternatives, modifications and equivalents as may be included within the spirit and scope of the disclosure as defined by the appended claims.

The disclosure will now be described by reference to a preferred embodiment xerographic printing apparatus that includes a method for removing moisture from the surface of a photoreceptor.

For a general understanding of the features of the disclosure, reference is made to the drawings. In the drawings, like reference numerals have been used throughout to identify identical elements.

Referring now to FIG. 1, an electrographic printing system is shown that includes the improved method for externally heating the surface of a photoreceptor in order to control moisture thereon in accordance with the present disclosure. The term "printing system" as used here encompasses a printer apparatus, including any associated peripheral or modular devices, where the term "printer" as used herein encompasses any apparatus, such as a digital copier, bookmaking machine, facsimile machine, multifunction machine, etc., which performs a print outputting function for any purpose.

In FIG. 1, a marking device 100 is shown that includes a photoreceptor 110 that advances through processing stations in the direction of arrow 8, a cleaning device 120, a developer 140, a transfer device 150, a detack device 160, a thick film charging device 200, an exposure device 170 and a controller 180. Controller 180 controls a charge being applied to the photoreceptor 110 by thick film charging device 200, then an image-wise pattern of light from exposure device 170 exposes and photo-discharges the photoreceptor 110. Subsequently, charged toner particles are provided to adhere to the discharged areas of the photoreceptor 110, then the controller controls the application of a charge, with a sign opposite to the charge applied to the photoreceptor 110, to the receiving substrate at the transfer device 150 to remove the developed toner while retaining the image-wise pattern, and some additional charge is applied via the detack device 160 to the substrate to facilitate stripping of the substrate from the photoreceptor 110. Residual toner is then cleaned off the photoreceptor 110 by cleaner 120.

Figure 2:
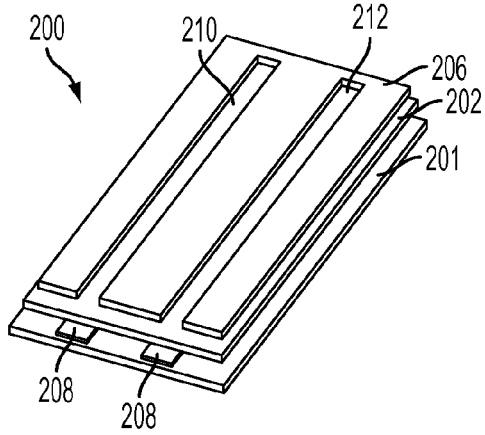
FIG. 2 is perspective view of the thick film charging device in accordance with the present disclosure used in the printing apparatus of FIG. 1.
Figure 3:
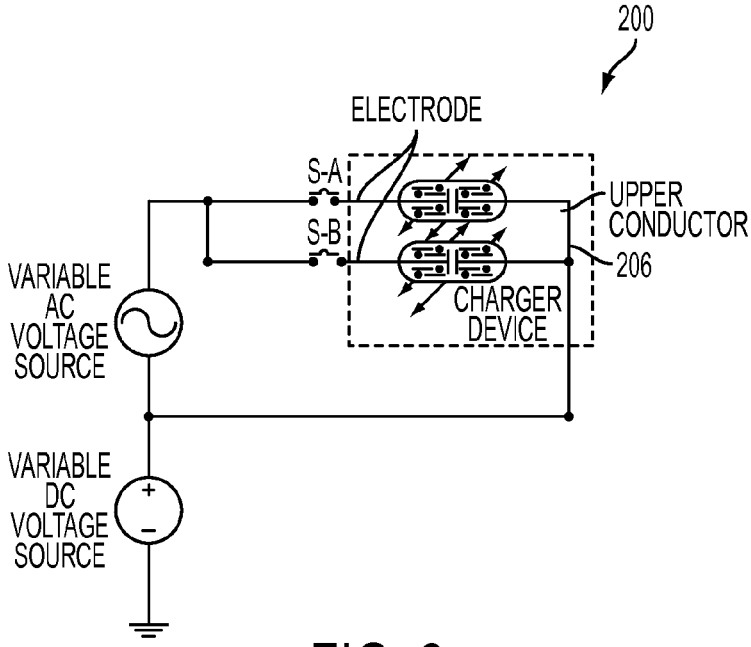
FIG. 3 is an electrical schematic for controlling ion production of the electrodes shown in FIG. 2.
Figure 4:
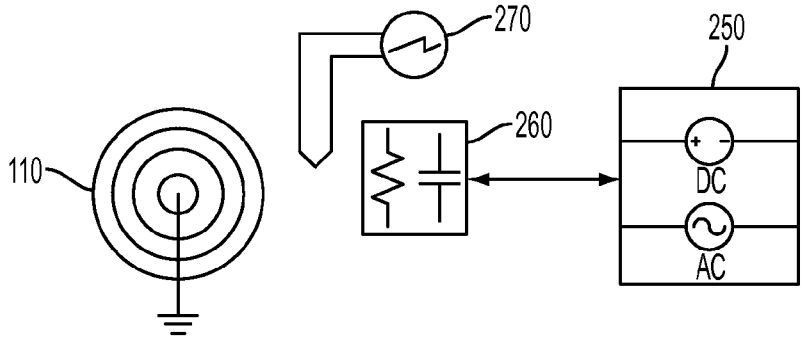
FIG. 4 is a thick film charging device operational depiction.

In accordance with the present disclosure, the heat generated by grid less, dual functioning scorotron or thick film charging device 200 is used to prevent image blurring by controlling moisture on photoreceptor 110 as shown in FIGS. 2-4. The grid less scorotron in FIG. 2 is located in close proximity to, but not touching the surface of photoreceptor 110, to charge and simultaneously warm the photoreceptor. Thick film charging device 200 comprises a ceramic substrate 201 that supports a dielectric layer 202 positioned between two conductive layers 206 and 208. Conductive layer 206 includes slots 210 and 212 therein while conductor 208 is in the form of two conductive strips with the two conductive strips underlying the slots 210 and 212 of the upper electrode. Corona generation is created within the slots 210 and 212. The non-contact, thick film device 200 is placed in free space, i.e., not surrounded by a heat sink, in close proximity to the surface of photoreceptor 110. The non-contact, grid less scorotron is aligned directly parallel to photoreceptor 110 as shown in FIG. 1 to achieve uniform charging and uniform heating of the photoreceptor. Energizing conductive layers 206 and 208 charges the surface of the photoreceptor to a relatively high, substantially uniform potential and at the same time raises the temperature of the surface of the photoreceptor. Intrinsic to the operation of the grid less scorotron is allowing the thin ceramic substrate to float freely in space to achieve critical temperature to minimize the creation of ozone.

The electrical schematic in FIG. 3 depicts grid less scorotron device 200 in a two line operational mode. Each line has one electrode (lower conductor) and all electrodes have a common upper conductor (FIG. 2). The number of electrodes is dependent upon the charging device application and the ceramic substrate's physical dimensions and the amount of power needed for the application.

The charging device's selected materials allow for the thick film circuit to handle AC and DC voltages as high as 3000 volts pk-pk. The ceramic's rigidity permits the device to be suspended adjacent photoreceptor 110, while being supported at its ends.

Switch S-A controls the AC high voltage delivered to the first electrode while switch S-B delivers the AC high voltage to the second electrode. Operation of the charging device required the AC voltage to be greater than 1800 volts pk-pk in order to strike corona. The upper conductor is connected to the variable DC voltage supply.

Corona generation occurs when the electrodes are subjected to AC high voltage. The electrical fields that surround the electrodes cause the air molecules to ionize on the surface of the dielectric between the upper conductor fingers in slots 210 and 212 (FIG. 2). The upper conductor is further energized to a DC voltage which establishes and controls the charge on photoreceptor surface. The grid less scorotron generates a plasma field which enables the DC charge to flow from the top conductive layer onto the photoreceptor surface which heats the ceramic substrate to a high temperature.

In the operational depiction of grid less scototron 200 shown in FIG. 4, a plasma field is generated by voltage controls as represented by box 250 energizing grid less scorotron represented here as box 260 which enables the DC charge to flow from the top conductive layer of the device onto the surface of photoreceptor 110 and which heats the ceramic substrate to a high temperature. The heat generated by the grid less scorotron is measured by a thermistor 270. Placement of the grid less scorotron with respect to the photoreceptor 110 is critical in order to simultaneously charge the surface of the photoreceptor heating and the air between the grid less scorotron and the surface of the photoreceptor 110 to a degree just sufficient to eliminate any moisture on the surface of the photoreceptor.

Figure 5:
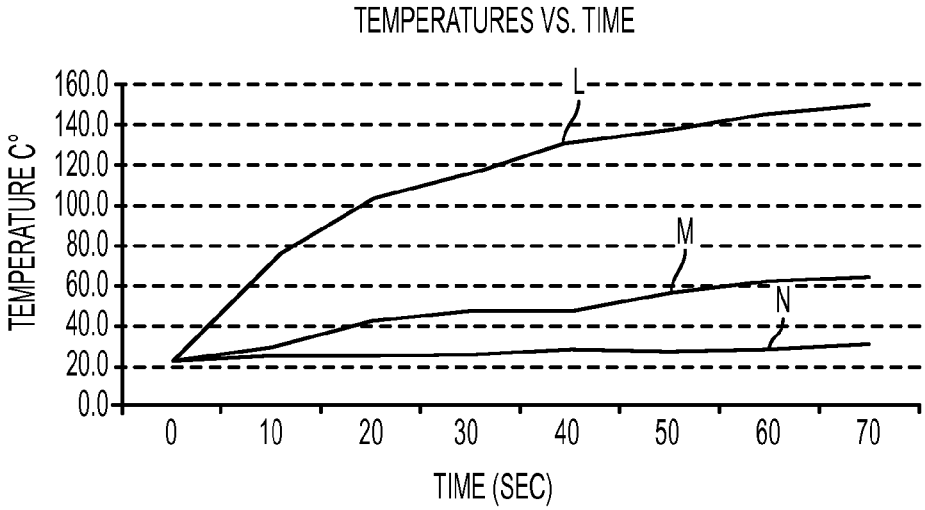
FIG. 5 is a chart showing the heat in the air around the photoreceptor over a specific time.

As shown in the chart of FIG. 5, within 10 seconds of actuation, the grid less scorotron represented by line L achieves temperatures of 71.5° C. The surrounding air at 1.5 mm from the grid less scorotron is at approximately 29° C. as represented by line M, an increase of 7° C. from ambient. The photoreceptor while rotating begins to heat up uniformly. Within 60 seconds the drum as represented by line N will be at 24° C. without the need for any other heating element. These temperatures were achieved without the use of a cleaner blade and in an open system.

An advantage of the heretofore described method for removing moisture from the surface of a photoreceptor is that the photoreceptor surface thickness can be reduced allowing for faster heating because solid state charge device 200 does not transmit vibration to the photoreceptor which is typical in Bias Charge Roll (BCR) charging systems that touch the photoreceptor surface. BCR charging systems cause the photoreceptor to 'sing' at the AC current frequency and require additional mass added to the photoreceptor substrate to dampen the vibration. Reducing this additional mass that can exist as thicker aluminum or added plastic silencers represents an additional cost savings.

In recapitulation, the grid less, solid state charging scorotron embodiment of the present disclosure is configured to simultaneously heat a photoreceptor as it is being charged in order to mitigate image quality defects associated with the photoreceptor in high humidity conditions. Solid state charging is based on a DC-offset AC voltage waveform to generate an AC corona at a set of dielectric supported electrodes positioned on a substrate. The combination of the AC frequency and amplitude results in dielectric heating of the substrate. Proximity to the photoreceptor of the charge device results in mild heating of the photoreceptor which in turn reduces humidity induced lateral charge migration and image blur at high humidity. Thus, a benefit is realized in the use of heat generated by the charge device itself to mitigate image quality defect that sometimes occur at high humidity. It is contemplated that heating can be gated ON/OFF with the magnitude of the AC pk-pk voltage.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A method for removing moisture from a photoreceptor in a xerographic device, comprising:

providing a drum with a photoreceptor surface thereon;

providing a heaterless solid state charging device for charging said photoreceptor surface;

providing a single power supply for supplying power to said solid state charging device; and simultaneously charging and heating said photoreceptor surface with said heaterless solid state charging device to remove moisture from said photoreceptor surface and thereby eliminate image blur.

2. The method of claim 1, including positioning said solid state charging device to achieve uniform charging and uniform heating of the photoreceptor.

3. The method of claim 1, including positioning said solid state charging device about 1.5 mm away from said photoreceptor surface.

4. The method of claim 1, including positioning said solid state charging device at least 1.5 mm away from said photoreceptor surface.

5. The method of claim 1, wherein said solid state charging device is non-contacting with respect to said photoreceptor surface.

6. The method of claim 5, including positioning a thermistor to measure the temperature of air between said solid state charging device and said photoreceptor surface.

7. The method of claim 6, wherein said dual functioning solid state charging device is non-contacting with respect to said surface portion of said photoreceptor substrate.

8. The method of claim 1, including heating said photoreceptor surface from outside said drum.

9. The method of claim 1, including providing an AC voltage to said solid state charging device and controlling heating of said solid state charging device by ON/OFF gating of the magnitude of said AC voltage to mitigate high humidity image quality defects.

10. A method for externally heating a surface of a photoreceptor, comprising:

providing a drum;

providing a photoreceptor substrate on said drum, said photoreceptor substrate including a surface portion;

providing a dual functioning solid state charging device, said solid state charging device including a ceramic substrate that supports a dielectric layer positioned between two conductive layers; and energizing solely said two conductive layers to charge said surface portion of said photoreceptor substrate and simultaneously raise the temperature of said surface portion of said photoreceptor substrate to remove moisture therefrom to eliminate image blur on said surface portion of said photoreceptor substrate in high humidity environments.

11. The method of claim 10, including providing uniform charging and uniform heating of said surface portion of said photoreceptor substrate.

12. The method of claim 10, including installing said drum and said solid state charging device into a xerographic apparatus.

13. The method of claim 10, including positioning said dual functioning solid state charging device at least 1.5 mm away from said surface portion of said photoreceptor substrate.

14. The method of claim 10, including positioning said dual functioning solid state charging device about 1.5 mm away from said surface portion of said photoreceptor substrate.

15. A method for preventing blurring of images on sheets, comprising:

providing an imaging apparatus for processing and recording images onto said sheets;

providing an image development apparatus for developing said images;

providing a transfer device for transferring said images onto said sheets;

providing a fuser for fusing said images onto said sheets;

providing said imaging apparatus with a drum photoreceptor and a dual use grid less scorotron charging device, said dual use grid less scorotron charging device comprising a ceramic substrate which supports a dielectric layer positioned between two conductive layers, and using solely corona produced from energizing of said two conductive layers to both charge a surface of said drum photoreceptor and simultaneously heat said surface of said drum photoreceptor to eliminate image blur on said drum photoreceptor surface in high humidity environments.

16. The method of claim 15, including incorporating said dual use grid less scorotron charging device into a xerographic device.

17. The method of claim 15, including positioning said dual use grid less scorotron charging device at least 1.5 mm away from said surface of said drum photoreceptor.

18. The method of claim 15, including positioning said dual use grid less scorotron charging device about 1.5 mm away from said surface of said drum photoreceptor.

19. The method of claim 15, wherein said dual use grid less scorotron charging device is non-contacting with respect to said surface of said drum photoreceptor.

20. The method of claim 15, including positioning said dual use grid less scorotron charging device to achieve uniform charging and uniform heating of said drum photoreceptor.

* * * * *